US005394950A

United States Patent [19]

Gardes

[11] Patent Number: 5,394,950

[45] Date of Patent: Mar. 7, 1995

[54] METHOD OF DRILLING MULTIPLE RADIAL WELLS USING MULTIPLE STRING DOWNHOLE ORIENTATION

[76] Inventor: Robert A. Gardes, P.O. Box 92593, Lafayette, La. 70508

[21] Appl. No.: 65,674

[22] Filed: May 21, 1993

[51] Int. Cl.[6] ..... E21B 7/06

[52] U.S. Cl. ..... 175/45; 175/61; 166/255

[58] Field of Search ..... 175/61, 45, 80, 82, 175/73; 166/255

[56] References Cited

U.S. PATENT DOCUMENTS

| | | | |
|---|---|---|---|
| 1,806,509 | 5/1931 | Straatman | 175/79 |
| 2,327,658 | 8/1943 | Miller | 166/255 |
| 2,419,468 | 4/1947 | Smith | 166/255 X |
| 2,425,319 | 8/1947 | Hering | 166/255 |
| 4,303,299 | 12/1981 | Holland et al. | 166/255 |
| 4,420,049 | 12/1983 | Holbert | 175/61 X |
| 4,852,666 | 8/1989 | Brunet et al. | 166/117.5 |
| 5,035,292 | 7/1991 | Bailey et al. | 175/45 |
| 5,115,872 | 5/1992 | Brunet et al. | 175/61 |

FOREIGN PATENT DOCUMENTS

| | | |
|---|---|---|
| 37 08 444 | 9/1988 | Germany . |
| 796397 | 1/1981 | U.S.S.R. . |

*Primary Examiner*—Hoang C. Dang
*Attorney, Agent, or Firm*—Pravel, Hewitt, Kimball & Krieger

[57] ABSTRACT

A method of drilling radial boreholes from a first borehole without withdrawing the drill string from the hole, by providing a first carrier string, a drill string within the carrier string, and a method for orienting the position of the carrier string relative to the position of the inner string, so that the strings are co-oriented, without the need to retrieve either the carrier string or the inner drill string from the bore hole for drilling consecutive radial wells.

27 Claims, 7 Drawing Sheets

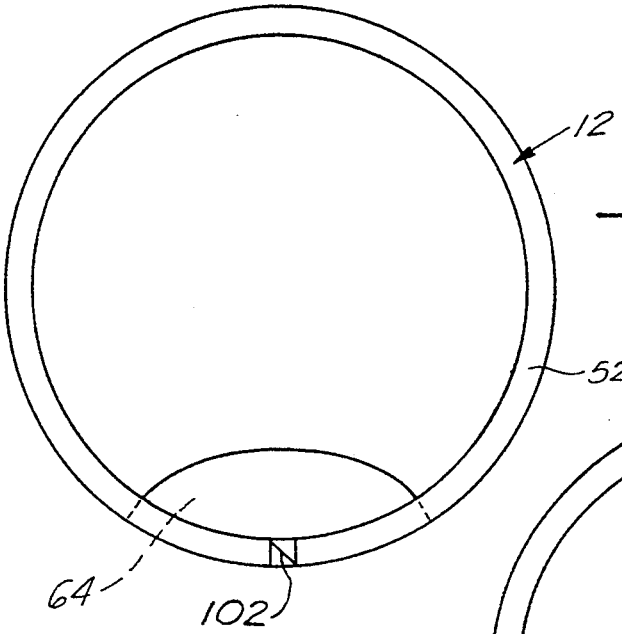
FIG. 7A
FIG. 7B
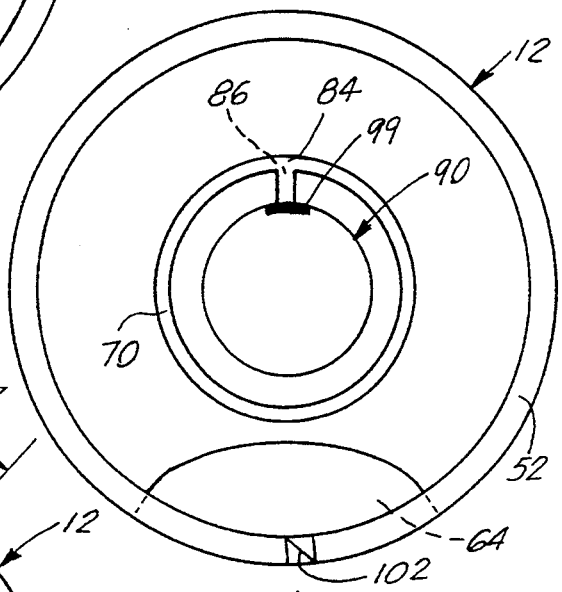
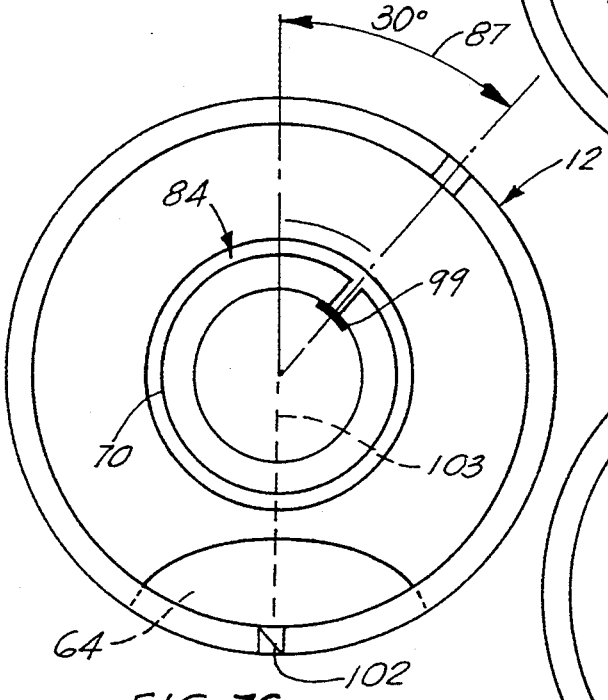
FIG. 7C
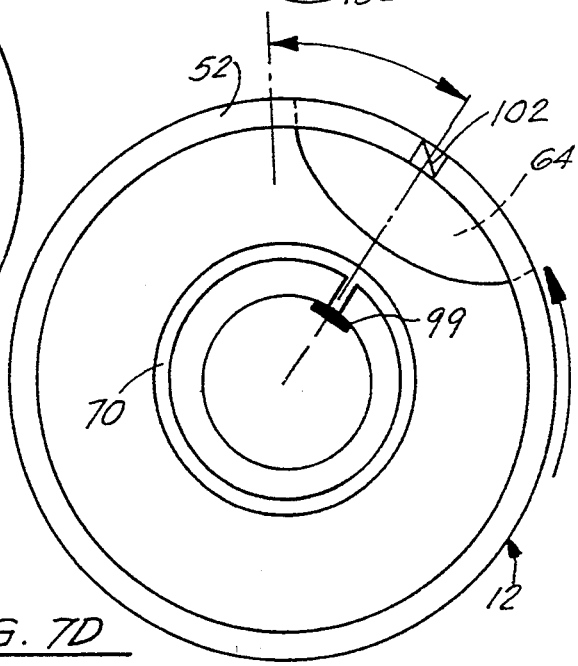
FIG. 7D

METHOD OF DRILLING MULTIPLE RADIAL WELLS USING MULTIPLE STRING DOWNHOLE ORIENTATION

BACKGROUND OF THE INVENTION

1. Field Of The Invention

The method of the present invention relates to the drilling of radial hydrocarbon and environmental wells, with offset well bores from vertical, directional or horizontal orientation. More particularly, the present invention relates to a drill string carried within a carrier string, and the method of orienting the two strings while both strings are downhole so that the strings are oriented in the same direction for drilling multiple radial offset well bores without retrieving either string from the hole.

2. General Background

In the field of drilling for gas, oil, or other hydrocarbons, as well as environmental wells, the drilling of radial wells is known in the art. For example, when a rather large pocket of oil or gas is hit in a field, oftentimes, numerous radial well bores, which are wells drilled radially off of a vertical, horizontal, or directional hole, are drilled to maximize the recovery of the liquid or gaseous hydrocarbons from the site. Such drilling is undertaken with the use of a steerable motor assembly consisting of a mud motor assembly of several types, including an articulated motor, double bent housing, singular bent housing, or bent sub with motor, which would be attached to the bit. The type of mud motor and bent housing utilized will determine the angular configuration of the radial well.

In accomplishing this method, a first straight, directional, or horizontal hole is drilled using conventional techniques. After completion of drilling, the drill string is retrieved from the well bore, and the radial drilling process is now ready to be implemented utilizing a two-string drilling technique. The first drill string is assembled with an upstock (which is a type of whipstock) which is multi-orientable without retrieving from the well bore. This string would now be called the carrier string, since it has the ability to carry another drill string inside of the carrier string. The carrier string is now lowered into the well bore to the site of the radial well bore point of origin. The upstock has an opening in its sidewall, to help guide yet a second, inner drill string therethrough, and begin its radial well bore. However, there are tremendous shortcomings to the present state of the art. The most prevalent is the need to be able to simultaneously orient both the outer and the inner drill strings so that the opening of the upstock ramp and the bent housing motor assembly are aligned. Additionally, the two strings must be oriented in the proper direction.

In the present state of the art, in order to accomplish this, the well is drilled, the first string is retrieved, and a carrier string with a upstock is lowered into position in the original wellbore. The inner string, with the bent housing motor assembly is then lowered into the carrier string, and the drilling process is ready to begin, as this assembly exits off of the upstock ramp and drills the first radial. Usually there are multiple radial wells to be drilled from this first hole. Therefore, after drilling the first radial, the inner string is pulled out of the hole, the upstock is retrieved, reset, and relowered back into the hole for the second radial. Each subsequent radial is drilled in this manner. Since time is money in drilling oil or gas wells, the time expended in this process is very extensive and the cost is very high.

These time and high cost factors become critical in certain settings. For example, it has been determined that the oil and gas reservoirs which have been abandoned in the United States may contain some 330 billion barrels of hydrocarbons, and some fields leaving some 70% of the hydrocarbons underground due to the poor recovery ability of correct production techniques. Therefore, if greater amounts of oil are to be retrieved in such settings, radial wells are very important to maximize recovery. However, as explained heretofore, the expense and time is almost prohibitive, under the current technology of drilling radial wells.

Therefore, it is critical that there be in the art a method of drilling multiple radial oil, gas, or environmental wells, which cut the time drastically and therefore reduce significantly the cost of drilling such multiple wells from a single first vertical, directional or horizontal well.

In the current state of the art there are numerous patents which address the drilling of radial wells, and these are cited in the Prior Art Statement which will be submitted in the filing of this application.

Other objects of the invention will be obvious to those skilled in the art from the following description of the invention.

SUMMARY OF THE PRESENT INVENTION

The method of the present invention solves the shortcomings in the art in a unique manner. What is provided is a method of providing a first carrier string, a drill string within the carrier string, and a method for orienting the position of the carrier string relative to the position of the inner string, so that the strings are co-oriented, without the need to retrieve either the carrier string or the inner drill string from the bore hole for drilling consecutive radial wells. The method includes the steps of drilling a hole with a first drill string; retrieving the first drill string from the drilled hole; attaching a deflection tool, such as a upstock, onto the first string, which becomes known as the carrier string, and lowering it into the drilled hole; lowering a second drill string having a drill bit on its lower end through the bore of the carrier string; lowering a steering tool into the second drill string and upon activation of the steering tool, determining the high side or gyro orientation (in the event there is magnetic interference) of the bent housing on the second drill string and determining a magnetic orientation of the carrier string by artificially creating a magnetic north on the carrier string, either by use of magnets or electromagnetic means; (thus high side or gyro orientation can now be aligned with magnetic orientation and both strings are oriented in the same direction); and providing a magnetic orienting tool associated with the carrier string to orient the carrier string with the orientation of the second drill string so that both strings are oriented in the same direction. The inner drill string, now properly oriented, will then be moved forward through the upstock to drill the radial well. Upon completion of the radial well, the drilling assembly of the second drill string is retrieved back into the carrier string, the second drill string is reoriented to a second preselected orientation with the use of the steering tool, the carrier string is reoriented with the magnetic orienting method, and the second radial hole is drilled. This method is repeated until all radial holes are drilled, without having to withdraw either the drill string or the carrier string from the hole during the process.

Therefore, it is a principal object of the present invention to provide an orientation method of drilling multiple radial wells from a single well, without having to retrieve either the carrier string of the drill string from the single well during the process of drilling the multiple wells.

It is a further principal object of the present invention to drill a radial well from a first well bore, by orienting both the carrier string and the drill string, while both strings are downhole, and without having to retrieve either string from the hole following the orientation.

It is a further object of the present invention to provide a method of drilling a radial well by utilizing a combination of high-side orientation and magnetic orientation for the carrier string and the drill string.

It is a further object of the present invention to provide a gyro to orient the drill string when the system is utilized preferably in vertically aligned, cased well where there may be magnetic interference, which the gyro would eliminate;

It is a further object of the present invention to provide a method of drilling multiple radial wells from a single wellbore, by orienting the drill string with a steering tool lowered into the string using high side orientation or gyro orientation, and by orienting the carrier string in relation to the inner string by using magnetic orientation, with the high side or gyro orientation serving as the main orientating means for drilling. The steering tools come with magnetometers, and these are used to allow the drilling assemblies to be oriented in a magnetic direction North, South, East, and West. What we are doing is creating an artificial north by use of magnets or electromagnets. This is placed in line with the opening of the upstock ramp. So when the steering tool which is in the inner drill string is lowered to a point where the magnets or electromagnets can now override the earth magnetic forces, the steering tool will now point to the new magnetically induced North which happens to be the upstock ramp opening, so that the two strings are orientated in the same direction downhole.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein:

FIGS. 7A–7D illustrates views of the positioning of the inner drill string within the carrier string in the dual orientation of the two drill strings for radial drilling.

DETAILED DESCRIPTION OF THE PREFERRED EMBODIMENT

Figure 1:
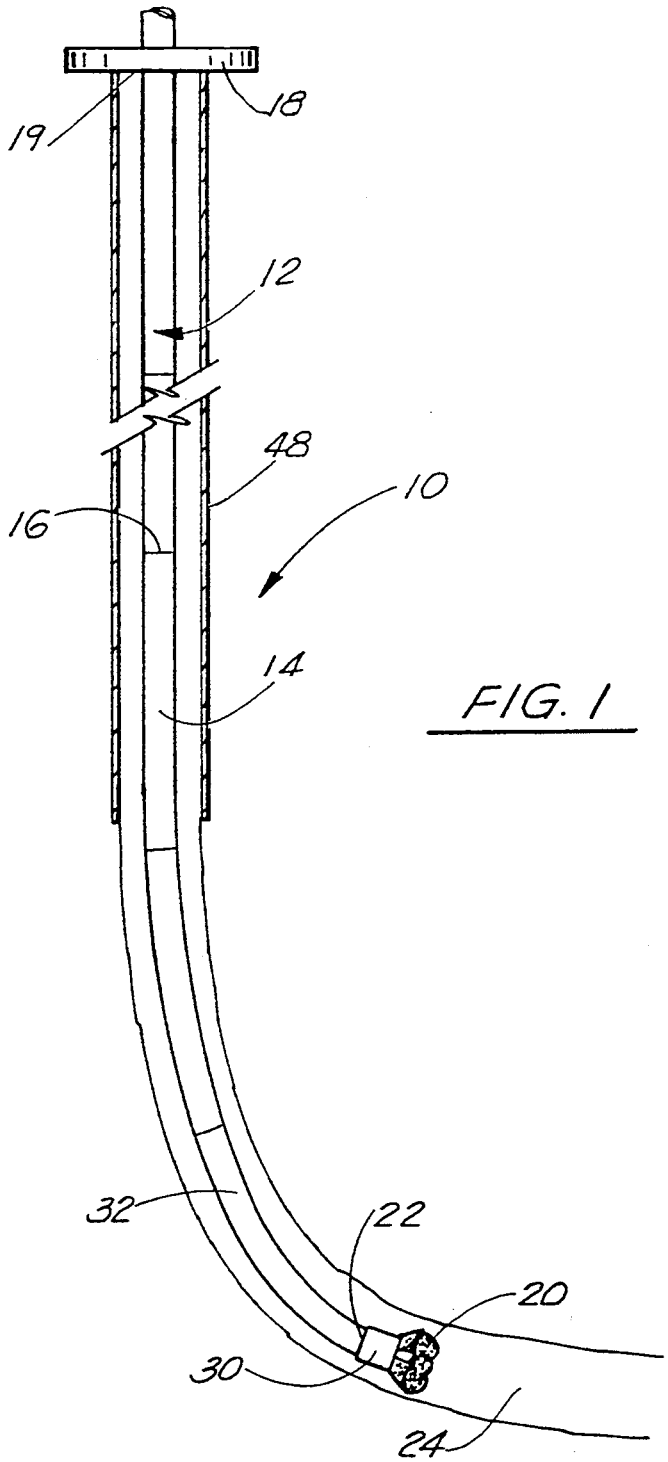
FIG. 1 illustrates a typical drill string utilized during drilling of a non-vertical well.

The method of the present invention is discussed below by reference to the drawings, FIGS. 1 through 8. Turning to FIG. 1 there is provided a typical drilling system 10. System 10 provides a drill string 12 comprised of numerous sections of drill pipe 14 threadably interconnected together at joints 16, to form what is referred to as the "drill string" 12. Drill string 12 is secured to a rotary table 18 on its upper end 19, and includes a drill bit 20 on its lower end 22, which is shown drilling a bore hole 24 into the earth, as the rotary table 18 rotates the string 12. This combination is very well known in the art, and is not novel. In the present invention, the borehole would usually be non-vertical or even horizontal in orientation, as seen in FIG. 1. Therefore, rather than drilling through the use of the rotating rotary table 18, the drill string 12 would include a mud motor 30 positioned above the drill bit 20, which would rotate the bit 20 without rotating the entire drill string 14. In this manner, by utilizing a steerable bent housing motor or a bent sub 32 above the mud motor 30, the borehole 26 would be arced as seen in FIG. 1, and could even form a horizonal configuration. This method of drilling is very important, so as to enhance recovery and because of the high cost of recovery if the conventional methods were utilized.

Figure 2:
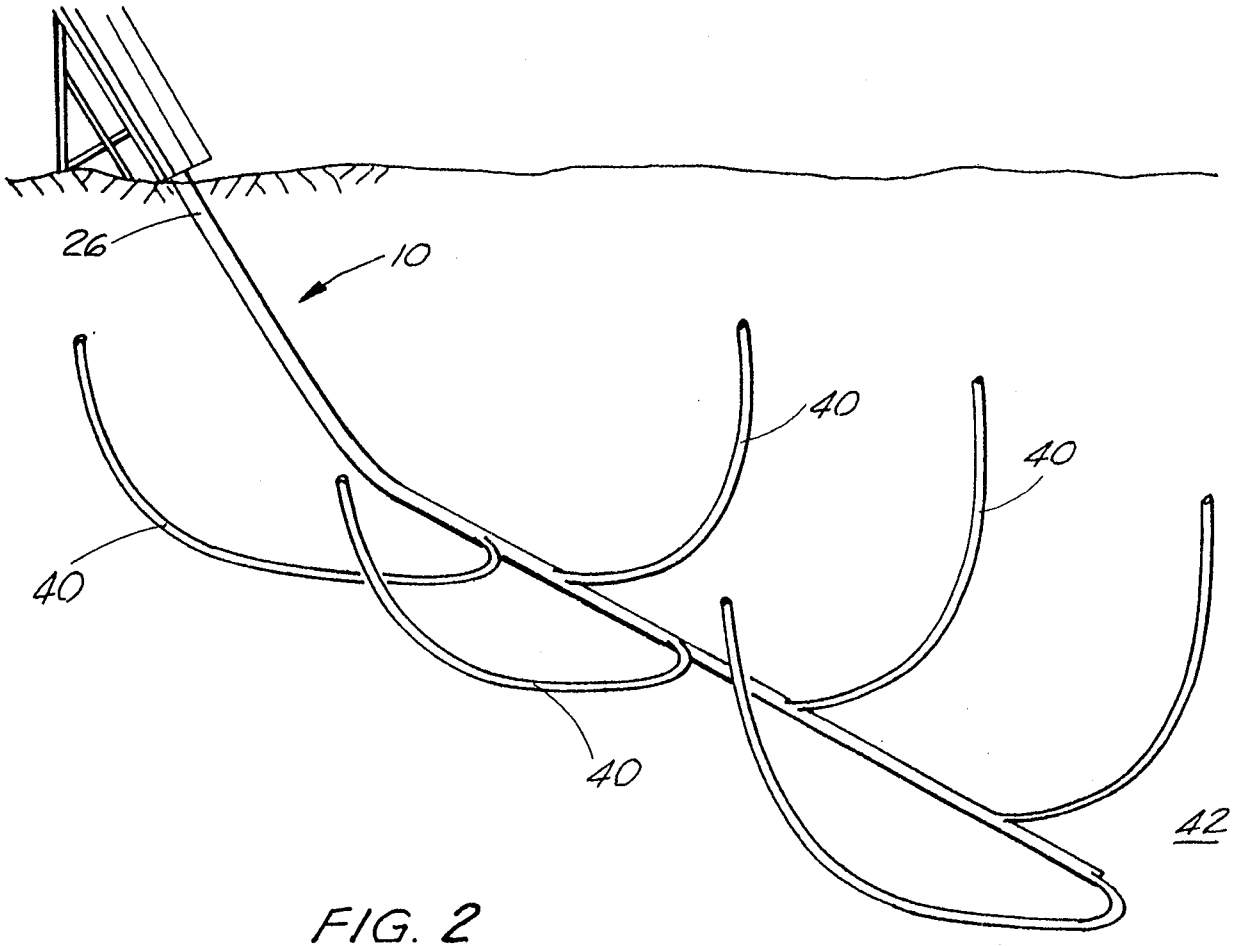
FIG. 2 illustrates a schematic depiction of a series of radial wells being drilled from the initial non-vertical well in FIG. 1.

One further step in the drilling process as seen in FIG. 2, is the ability to drill a series or "radial" wells from either a single horizontal or single vertical borehole. FIG. 2 illustrates schematically a series of radial boreholes 40 coming off of a principal borehole 26, which when done, would greatly increase the production from a particular hydrocarbon formation 42. However, as described earlier in this application, the time and money involved in such a plurality of radial wells is often prohibitive. However, the method of the present invention reduces the time significantly, since the carrier string does not have to be removed from the borehole and reoriented after each radial is drilled, and hence results in a tremendous monetary saving to the drilling of the multiple radial wells 40.

Figures 3, 4:
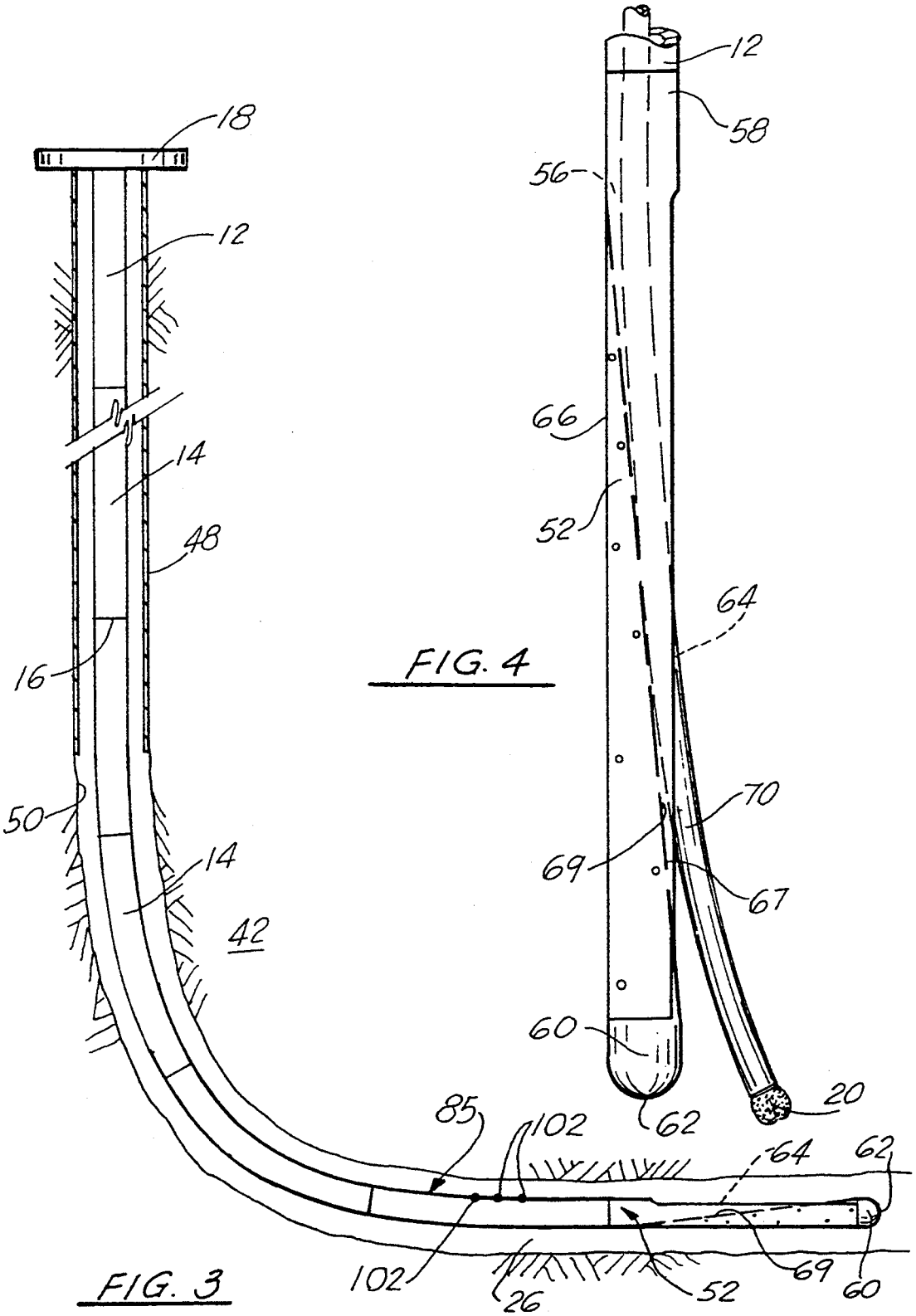
FIG. 3 illustrates the positioning of the carrier string including the upstock within the well casing in the process of the present invention.
FIG. 4 illustrates a detail view of the upstock utilized in the process of the present invention.

As illustrated, the method of the present invention would provide a first conventional drill string 12, which as seen in FIG. 3, has drilled a first horizontal borehole 26 to a predetermined depth as needed. The borehole 26 may be cased or un-cased, depending on factors surrounding the drilling. There is represented a metal casing 48 lowered into the borehole to guarantee the integrity of the wall 50 of the borehole 26 during the subsequent process. Following the step of drilling this first borehole 26, the drill string 12 is retrieved from the well, and the borehole 26 remains with the casing as illustrated in FIG. 3. Next, upon retrieval of the drill string 12 from the borehole 26, the drill bit 20 and bent sub 32 are removed, and a means is threadably secured to the drill string 12 for allowing radial wells to be drilled from this string, now called a "carrier string" 12.

Figure 5:
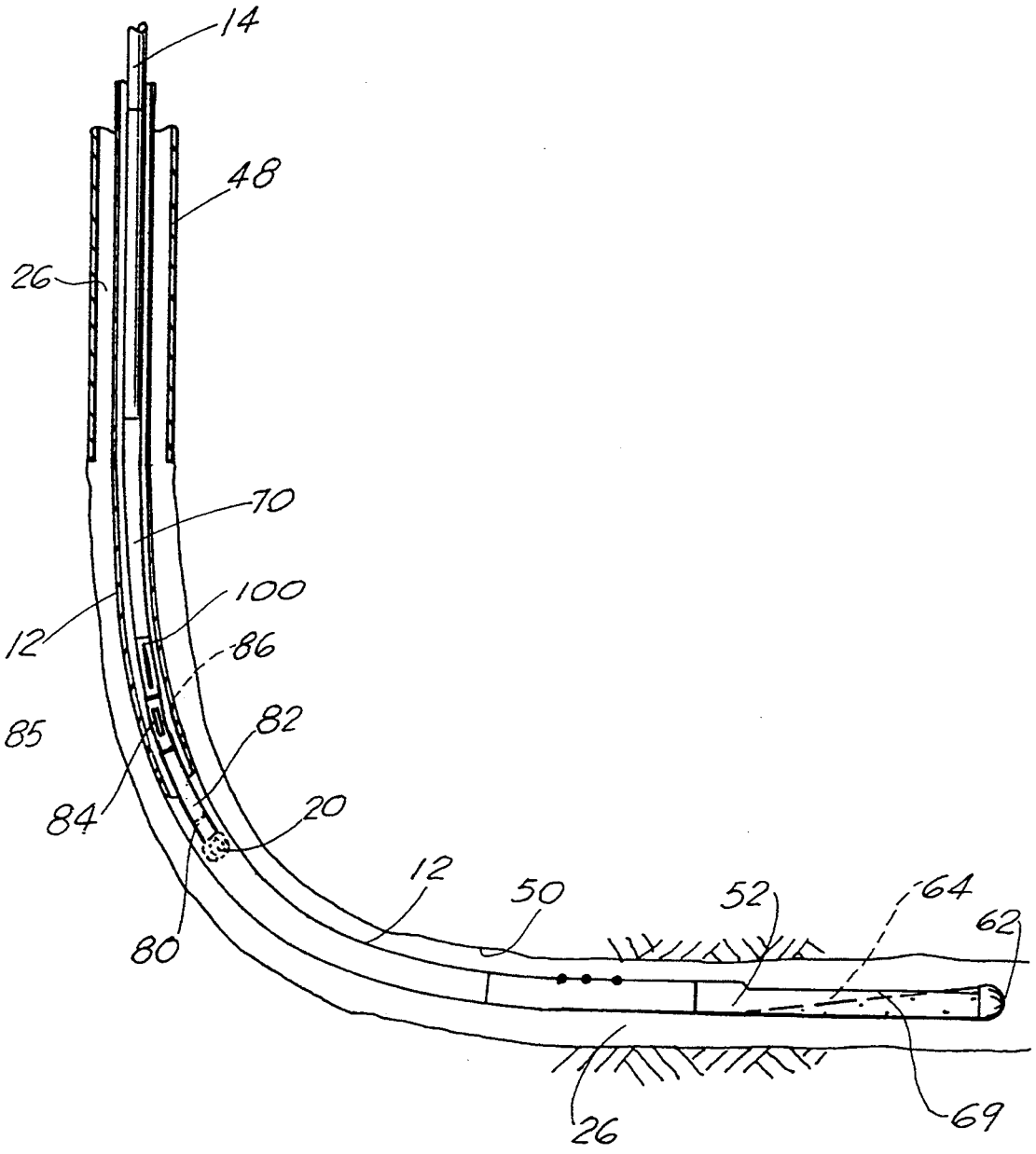
FIG. 5 illustrates the inner drill string positioned within the carrier string in the process of the present invention.

This means would comprise an upstock 52, as seen in FIG. 4. As seen in the Figure, the upstock 52 would include an elongated body portion 54 having a bore 56 substantially therethrough. A first end 58 of the upstock 52 would threadably engage onto the lowest most end of the drill string 12. The second end 60 of the upstock 52 would preferably be rounded at 62 to allow it to slide down the borehole 26. The upstock 52 as seen in FIG. 4, would include a means for guiding an inner drill string 70 to drill a radial well. This means would include an opening 64 in the wall 66 of the upstock 52 of sufficient space to allow an inner drill string and bit to pass therethrough. Further, there would be provided a guide ramp 69 within the bore 56 of the upstock 52, so that as the bit 20 of the inner string 70 contacted the ramp 68, it would be guided along the ramp surface 67, out of the opening 64 in the wall 66 of upstock 52, and out into the earth to commence the radial borehole. Positioned directly above the upstock 52, along the carrier string, would be a means to establish a magnetic field around the string, this means comprising what is known in the art as a Monell collar 85, as illustrated in FIG. 5. The one or more Monell collars 85 further comprise a plurality of magnets 102 or electromagnets 102, which are utilized to allow the drilling assemblies to be oriented in a magnetic direction North, South, East, and West. When the magnets 102 on the collar 85 are activated, there is created an artificial north by use of magnets or electromagnets 102. As will be described further, this specific orientation is placed in line with the opening 64 of the upstock ramp 69, in preparation for lowering of a steering tool provided on an inner drill string that will be lowered into the bore of the carrier string 70, to a point where the magnets 102 or electromagnets could then override the earth magnetic forces. The steering tool would then point to the new magnetically induced North which is actually the upstock ramp opening 64, so that the carrier string 12 and the inner string are orientated in the same direction downhole.

It should be kept in mind that the process of the present invention is principally addressing the drilling of radial wells which are drilled from a non-vertical, non-cased borehole. However, often, the radial wells must be drilled from a vertical well which may or may not be cased. This presents two problems in orientation. First, because the well is vertical, the initial orientation is not known as would be for a non-vertical well, and thus must be established. Second, a cased well may involve magnetic interference from the metal casing, which would make orientation utilizing the Earth's magnetic field impossible. Therefore, to overcome these problems, in this setting, one could utilize a gyro, which is known in the art, to both establish the orientation and to avoid any magnetic interference. During the discussion of this method, there will be references to "high side or gyro" orientation which is addressing the method utilized in vertical, cased wells as discussed.

Turning now to these further steps in the process, as seen in FIG. 5, once the upstock 52 has been placed in the borehole 26 to a predetermined depth; for example, 6000 feet, the drill string 12 on which the upstock 52 is secured downhole is ready to receive an inner drill string 70 which would undertake the actual drilling of the radial wells. Inner drill string 70 would comprise a plurality of drill pipes 14 end to end, comprising the major part of the string. For purposes of the method, the inner string 70 may comprise a continuous length of coil tubing, which would be the equivalent of the plurality of sections of drill pipe 14. Whether the string is drill pipe or coil tubing, there would be provided a certain diameter drill bit 20 at the lower end of the string 70. Above the drill bit 20 there would be provided a mud motor 80, of the type known in the art, to undertake the powering of the rotation of the drill bit. These would be of the type including a bent housing mud motor, either single or double bent, and steerable mud motors. Following angle and direction, they would have the ability to slide and rotate the assembly to maintain the angle and the direction of a predetermined angular orientation depending on the angle of radial well to be drilled. The upper end of the sub 82 would be secured to a mule shoe sub 84, which is a component designed to receive a steering tool lowered on a wireline, which will be described further. These components are critical in orienting the inner drill string 70 and the carrier string 12, and will be described further in the process.

Next in the process, the inner drill string 70, as previously described, is then lowered into the carrier string 12 which has the upstock 52 on its lower end. Through measuring the length of inner drill string 70 lowered into the hole, the inner string 70 is lowered to a position such that the drill bit 20 rests in the bore of the carrier string 12, at some point above the upstock 52, as illustrated in FIG. 5.

Figure 6:
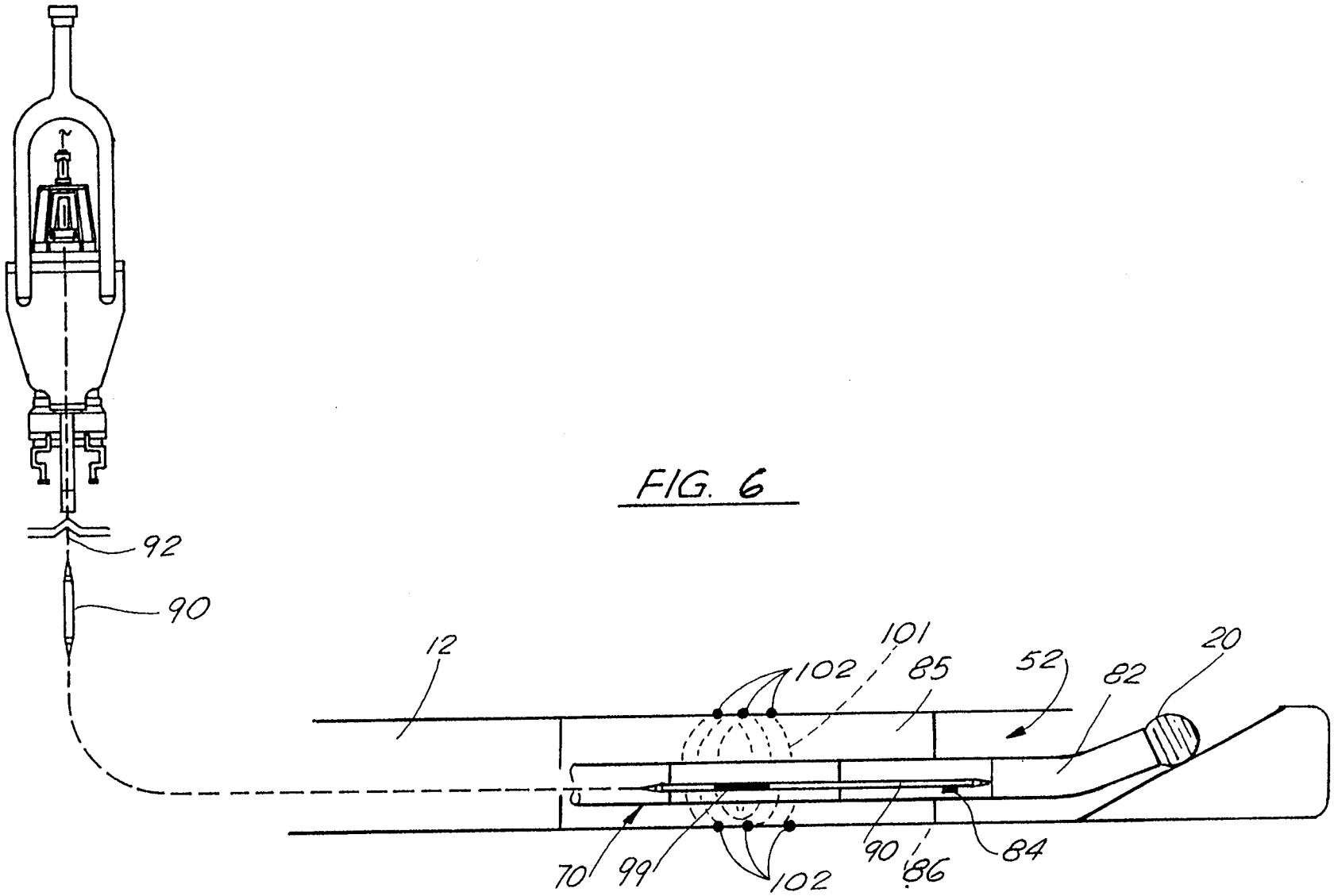
FIG. 6 illustrates the steering tool positioned within the inner drill string in the process of the present invention.

Following this step, FIG. 6 illustrates a steering tool 90, of the type for example, manufactured by DMI or Sharwell, known in the art, is lowered via a wireline 92 down the bore of inner drill string 70, as depicted in FIG. 5, to the point of the mule shoe 84, where the steering tool 90 is locked in place within a slot 86 in the mule shoe 84.

With the placement of the steering tool 90 engaged into the mule shoe 84, the steering tool 90 would be activated to show the position of the "high side or gyro orientation" of the inner string 70. Once that orientation has been established, and the inner string is positioned so that the steerable motor assembly is oriented in the direction of the preselected path, the inner string is then lowered to a point where the steering tool is positioned within the magnetic field of the carrier string magnetic orienting Monell collar 85. The steering tool 90 is then switched to magnetic orientation. The magnetometers 99 of the steering tool 90 then sense the magnetic field of the carrier string 12 and will then point to North. This artificially induced North is the orientation of the carrier string's upstock opening 64. By rotating the carrier string 12 to align North with high side or gyro, both strings will now be facing the same direction with the orientation of the inner drill string 70.

The steps in this process are illustrated in FIGS. 7A through 7D. As illustrated in FIG. 7A, the carrier string 12 has been positioned within the borehole with the upstock 52 at its lower end, and with the opening 64 in the wall of upstock 52 in no particular orientation at this point in the process. There is also illustrated the magnets 102 positioned in the wall of the Monell collars 85, in the carrier string 12, also illustrated in FIG. 3.

Turning now to FIG. 7B, as illustrated, the inner drill string 70, includes the bit 20, and the mule shoe 84, having the slot 86 to accommodate the steering tool 90. This string 70 has been lowered to a certain position within carrier string 12. The steering tool 90 is then locked into slot 86, and one is then ready to select the "high side or gyro orientation" of the inner drill string 70. As was discussed earlier, the steering tool 90 includes magnetometers which, when activated, sense the magnetic field of the magnets 102 in carrier string 12.

After the steering tool 90 is activated, it senses a straight up high side or gyro orientation as seen in FIG. 7B.

FIG. 7C illustrates that it has been determined that a radial wellbore will be drilled 30 degrees to the right of high side or gyro. In FIG. 7C, the inner drill string 70 is illustrated as rotated to 30 degrees right of high side or gyro by arrow 87. Following this initial orientation, the steering tool 90 carried by the inner string 12 is then activated for magnetic orientation. The magnetometers 99 of steering tool 90, once activated, will point to North or an artificially induced North, created by magnets 102 of Monell collars 85. At this point, the magnetometers 99 of the steering tool 90 will sense the magnets 102 located on the Monell drill collar 85 as shown by the phantom lines 103 of FIG. 7C as the Magnetic North orientation. The carrier string 12 can then be rotated in the direction of arrow 89 to align the magnets 102 with the orientation of the magnetometers 99 of steering tool 90. Therefore, as seen in FIG. 7D, the two strings are aligned precisely in the same orientation, so that the inner string 70 may be then allowed to drill through the opening 64 in the upstock 52 in the preselected 30 degree orientation.

Very crucial to the process is the fact that this dual orientation between the carrier string 12 and the inner drill string 70 can be accomplished without ever having to retrieve either string from the borehole 26.

Figure 8:
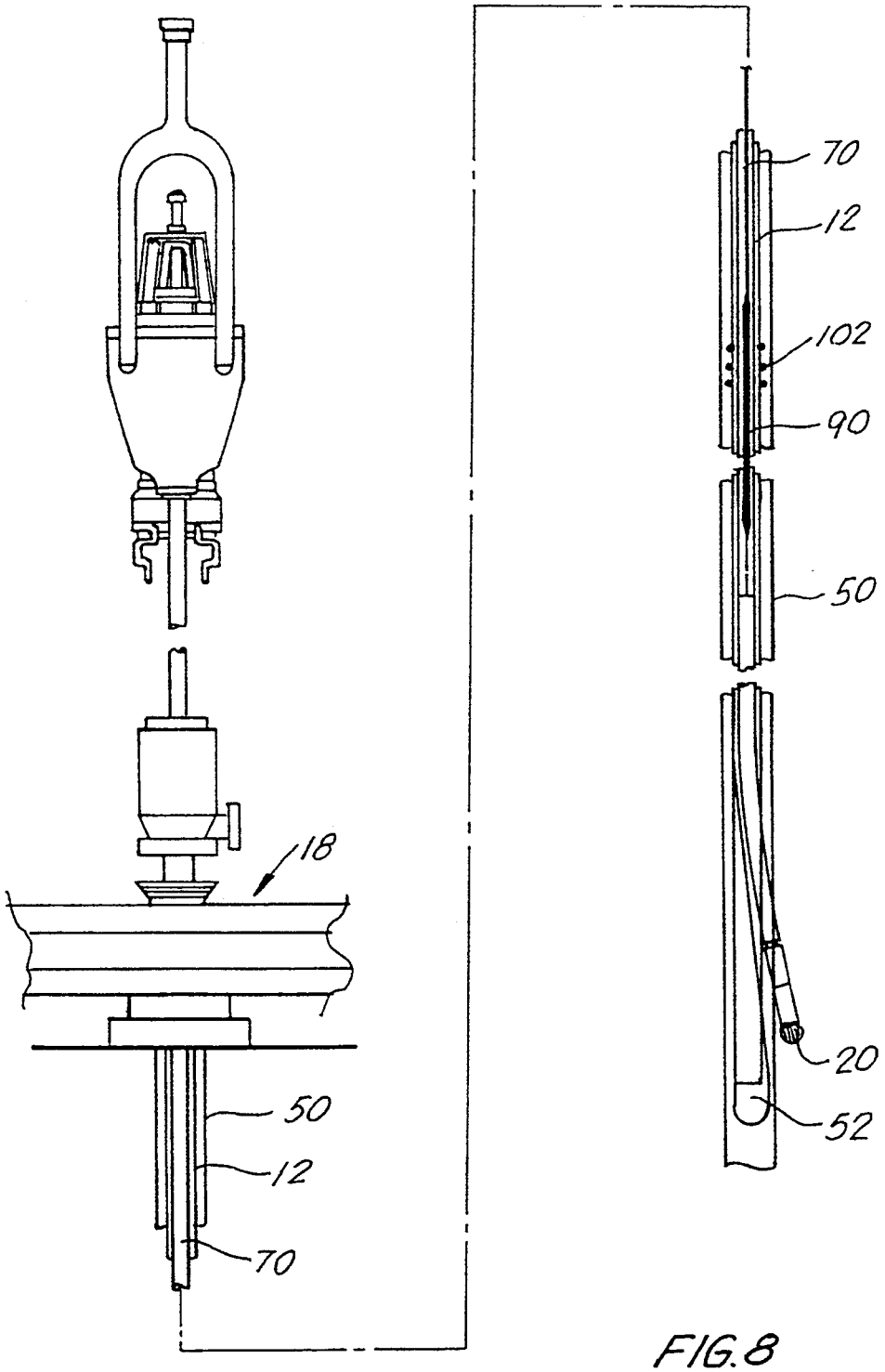
FIG. 8 illustrates the exiting of the inner drill string from the carrier string in order to drill the radial well.

Therefore, as illustrated in FIG. 8, following the drilling of the first radial bore 40, the inner drill string is ready to be retrieved back into the bore of the carrier string 12, in the position as seen in FIG. 5; the operator orients, via the power swivel, the inner string 70 to the next "high side or gyro orientation" selected. Once the high side or gyro orientation is in place, the magnetometers 99 within the steering tool 90, are activated. The carrier string 12 is rotated so that the magnetometers 99 sense the artificially induced North orientation as Magnetic North, and the two strings are again aligned for the drilling of the second radial. This process can be repeated indefinitely, and a plurality of radial holes can be drilled without ever returning either of the strings to the surface.

Glossary of Terms drilling system 10
drill or carrier string 12
drill pipe 14
joints 16
rotary table 18
upper end 19
drill bit 20
lower end 22
bore hole 24
non-vertical borehole 26
mud motor 30
bent sub 32
radial boreholes 40
hydrocarbon formation 42
casing 48
wall 50
upstock 52
body portion 54
bore 56
first end 58
second end 60
rounded portion 62
opening 64
wall 66
guide ramp 68
ramp surface 69
inner drill string 70
mud motor 80
bent sub 82
mule shoe sub 84
Monell collar 85
slot 86
arrow 87
steering tool 90
wireline 92
magnetometers 99
magnetic field 101
magnets 102
phantom line 103

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

I claim:

1. A method of drilling radial wells, comprising the following steps:

a) drilling a borehole with a first drill string;

b) retrieving the first drill string from the drilled borehole;

c) attaching a deflection means onto a carrier string and lowering it into the drilled hole to a preselected depth;

d) lowering an inner drill string having a mud motor drilling assembly on its lower end through the bore of the carrier string to a preselected depth within the carrier string;

e) lowering a first orienting means into the inner drill string and, upon activation of the first orienting means, determining the high side orientation of the inner drill string; and f) providing a second orienting means associated with the inner drill string to orient the deflection means of the carrier string with the high side orientation of the inner drill string so that both strings are in the same orientation.

2. The method in claim 1, wherein the deflection means comprises an upstock positioned at the lower end of the carrier string.

3. The method in claim 1, wherein the inner drill string includes a mud motor for driving the rotation of a drill bit.

4. The method in claim 1, wherein the first orientation means comprises a steering means to determine the high side or gyro orientation of the mud motor drilling assembly.

5. The method in claim 1, wherein the second orientation means comprises magnetic sensors within a first steering means.

6. The method in claim 5, wherein the second orientation means positions itself in line with the high side or gyro orientation of the inner drill string.

7. The method in claim 1, wherein the carrier string is positioned to align with a high side or gyro orientation of the inner string by rotating the rotary table.

8. The method in claim 1, wherein carrier string is oriented magnetically with the inner string following a high side or gyro orientation of the inner string.

9. The method in claim 1, wherein magnets or electromagnets attached to the carrier string creates a magnetic field which is sensed as being Magnetic North by magnetic sensors of a steering tool in the inner drill string.

10. The method in claim 8, wherein drilling will commence when the magnetic orientation has aligned itself with the high side or gyro orientation of the inner string, so that an opening in an upstock and the orientation of the mud motor are similarly oriented.

11. The method in claim 1, wherein an inner drill string of sections of drill pipe is oriented by a power swivel means.

12. The method in claim 1 wherein an inner drill string of coil tubing is oriented by the rotating means for a coil tubing system.

13. A method of drilling radial wells, comprising the following steps:

a) drilling a borehole with a first drill string;
b) retrieving the first drill string from the drilled borehole;
c) attaching a deflection means onto a carrier string and lowering the carrier string into the drilled hole to a preselected depth;
d) lowering a second drill string having a drill bit on its lower end through the bore of the carrier string to a preselected depth within the carrier string, inner drill string including a means for accommodating a first orientating means within its bore, and a means for aligning the first orientating means to a deflecting angle of the inner drill string;
e) lowering and securing the first orientating means into the inner drill string and upon activation of a steering means, determining the high side or gyro orientation of the drill bit on the inner drill string;
f) next, activating a magnetic sensing means of the first orientating means inside the inner string, so that upon activating the a magnetic sensing means, the magnetic sensing means senses artificially induced North and associates it as Magnetic North; and
g) aligning the sensed Magnetic North of the carrier string with the high side or gyro orientation of the inner drill string so that the magnetic sensing means of the carrier string aligns itself with the high side or gyro orientation of the inner string to provide alignment between the inner drill string and the carrier string.

14. A method of drilling radial wells, comprising the following steps:

a) drilling a borehole with a first drill string;
b) retrieving the first drill string from the drilled borehole;
c) lowering a carrier string having a deflection means on its end, and lowering the string into the drilled hole to a preselected depth;
d) lowering an inner drill string having a drill bit on its lower end through the bore of the carrier string to a preselected depth within the carrier string;
e) providing a means on the inner drill string to adapt a steering tool to the inner drill string, and a means to magnetically sense orientation;
f) lowering and securing the steering tool into the inner drill string and upon activation of the steering tool, determining the high side or gyro orientation of the drill bit on the inner drill string;
g) activating the magnetic sensing means, for sensing the position of carrier string orientation as Magnetic North;
h) aligning the magnetic sensing means of the carrier string with the high side or gyro orientation of the inner drill string so that the magnetic sensing means of the carrier string aligns itself with the high side or gyro orientation of the string to provide alignment between the two strings;
i) drilling a radial well with the inner string off of the deflection means to a preselected depth; and
j) retrieving the inner drill string back into the carrier string and repeating steps e) through i) above.

15. The method in claims 13 or 14, wherein the deflection means comprises an upstock positioned at the lower end of the carrier string.

16. The method in claims 13 or 14, wherein the inner drill string includes a mud motor for driving the rotation of the drill bit.

17. The method in claims 13 or 14, wherein the first orientation means comprises a high side or gyro orientation system.

18. The method in claims 13 or 14, wherein the second orientation means comprises a magnetic orientation system.

19. The method in claims 13 or 14, wherein the magnetic magnetic sensing positions itself in line with the high side or gyro orientation of the inner drill string.

20. The method in claims 13 or 14, wherein the carrier string is rotated and positioned by rotating a rotary table.

21. The method in claims 13 or 14, wherein the carrier string is oriented magnetically with the inner string following the high side or gyro orientation of the inner string.

22. The method in claims 13 or 14, wherein magnets or electromagnets create an artificially induced Magnetic North which is the means by which the magnetic sensing means senses its position relative to the high side or gyro orientation.

23. The method in claims 13 or 14, wherein drilling will commence when the magnetic orientation has aligned itself with high side or gyro orientation, so that an opening in the deflection means and the orientation of the drill bit are similar.

24. The method in claims 13 or 14, wherein an inner drill string of sections of drill pipe is oriented by a power swivel means.

25. The method in claim 13 or 14 wherein an inner drill string of coil tubing is oriented by a rotating means for a coil tubing system.

26. A method of drilling radial wells, comprising the following steps:

a) drilling a borehole with a first drill string;
b) retrieving the first drill string from the drilled borehole;
c) attaching a deflection means onto a carrier string and lowering it into the drilled hole to a preselected depth;
d) lowering an inner drill string having a mud motor drilling assembly on its lower end through the bore of the carrier string to a preselected depth within the carrier string;
e) lowering orienting means into the inner drill string;
f) activating said orienting means, to orient the mud motor drilling assembly of the inner drill string and the carrier string so that both strings are in the same orientation;

g) drilling a radial bore with the inner drill string; and h) retrieving the inner drill string back into the carrier string and reorienting the mud motor drilling assembly of the inner drill string and the carrier string to drill each subsequent radial bore.

27. A method of drilling radial wells, wherein a borehole is drilled with a first drill string, after the first drill string is removed a carrier string is introduced into the borehole to a preselected depth, and an inner drill string having a mud motor drilling assembly is lowered into the tarrier string to a preselected depth within the carrier string, the method comprising:

a) providing a first orienting means in the inner drill string for determining the high side orientation of the inner drill string; and b) providing a second orienting means associated with the inner drill string to orient a means on the carrier string with the high side orientation of the inner drill string so that the carrier string and the inner drill string are similarly oriented for drilling the radial well.

* * * * *